US005505677A

United States Patent [19]

Hinds

[11] Patent Number: 5,505,677

[45] Date of Patent: Apr. 9, 1996

[54] EXERCISE APPARATUS USING ELASTIC CABLE

[76] Inventor: Robert S. Hinds, 1803 Regent St., Madison, Wis. 53705

[21] Appl. No.: 102,062

[22] Filed: Aug. 4, 1993

[51] Int. Cl.[6] ..... A61F 5/00

[52] U.S. Cl. ..... 482/10; 602/17; 482/129

[58] Field of Search ..... 482/10, 129, 139; 606/240; 602/17

[56] References Cited

U.S. PATENT DOCUMENTS

| | | | |
|---|---|---|---|
| 559,270 | 4/1896 | Edwards | 482/10 |
| 1,517,147 | 11/1924 | Burnett | 482/10 |
| 1,543,346 | 6/1925 | Titus | 482/10 |
| 5,242,347 | 9/1993 | Keeton | 482/10 |
| 5,248,293 | 9/1993 | Hubbard et al. | 602/17 |

FOREIGN PATENT DOCUMENTS

| | | | |
|---|---|---|---|
| 0073690 | 11/1916 | Switzerland | 482/10 |

*Primary Examiner*—Lynne A. Reichard
*Attorney, Agent, or Firm*—Keith Schoff

[57] ABSTRACT

Elastic cable exercise apparatus is provided with adjustably positionable, rotatable hand-hold grips, safety loop means for arresting cable contraction when a door is utilized for anchoring the cable, and a harness for being worn on the head and attached to a cable to facilitate exercise of neck muscles.

7 Claims, 8 Drawing Sheets

EXERCISE APPARATUS USING ELASTIC CABLE

FIELD OF ART

Exercise apparatus is used for muscular conditioning, both for athletic training and for physical therapy.

BACKGROUND OF INVENTION

Muscular exercise apparatus have used weights, spring loaded mechanical devices, and elastic cable to provide resistance to movement of a user's torso, head or limbs by physical exertion as a means for strengthening specific muscles. Elastic cable prior art exercise devices include those shown in U.K. patents 27,611, 26,180, and 1,112,114, and in U.S. Pat. Nos. 1,965,511, and 4,779,867. The prior art does not show means for adjusting cable length nor safety provisons for preventing injury to a user in the event of failure of means anchoring a cable.

SUMMARY OF THE INVENTION

The elastic cable exercise apparatus of this invention provides quick release grips which can be easily repositioned along a length of elastic cable for convenience of use, particularly with physical therapy cable to accomodate the needs of those who may be physically disabled. A grip is configured as a stirrup with an eye opening through a wall section, the eye opening being conically configured with cable threaded through the opening and a ball with leader attached being inserted in the eye opening to compress and bind the cable against the wall. To release the cable, the leader is pulled to remove the ball from the opening and free the cable. Further, the handhold portion of the grip may be axially rotatable and be sheathed with a tubular cushioned material to facilitate use. The handhold portion may comprise a longitudinally split cylinder with snap closures enclosed within a tube of resilient foam material with the ends of the cylinder being journaled on fixed lugs extending from the sidewalls of the grip. The cable may be conveniently anchored to a hinge mounted door and be provided with a safety loop to protect against inadvertent release of a cable from its anchorage during use. A head harness attachment for the cable is also provided which enables neck exercises in extension, flexion, and lateral rotation to be performed against the resistence of stretched elastic cable.

DESCRIPTION OF THE INVENTION

Figure 1:
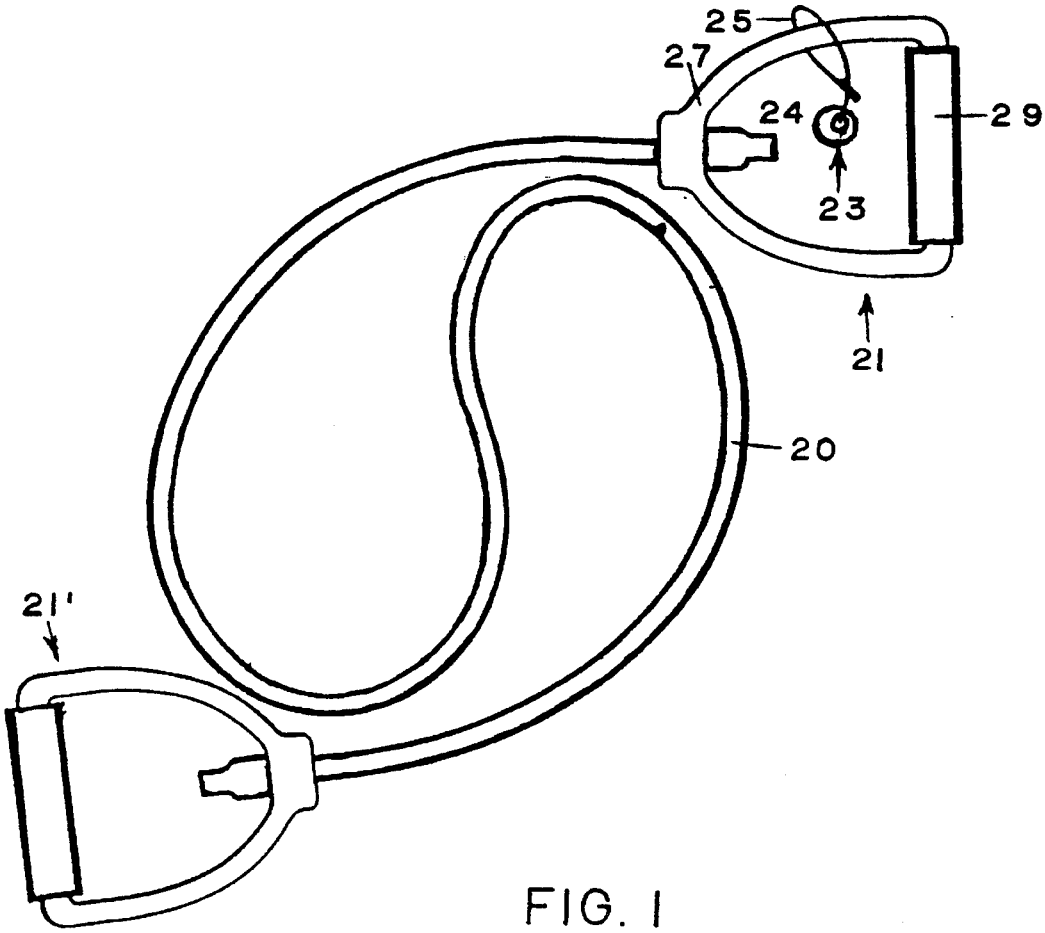
FIG. 1 is an elevation view of an elastic cable equipped with two rotator grip embodiments of this invention wherein one grip is provided with a grip positioning adjustment member.
Figure 2:
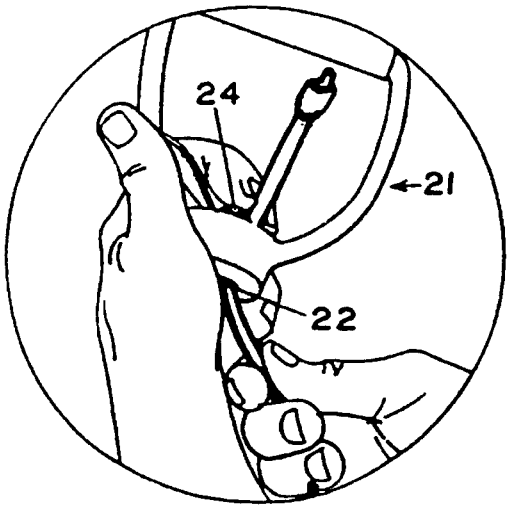
FIG. 2 is a detail view of the grip poitioning adjustment member of FIG. 1 being placed in position to secure a grip on the cable.

In FIGS. 1 and 2 tubular elastic exercise cable 20 is shown with grips 21, 21' affixed to opposite ends. The cable is conveniently about seven feet long, preferably, and may comprise a variety of wall thicknesses and elastic compositions, depending on the use to be made of the apparatus, whether for athletic training or physical therapy. Grips 21, 21' are preferably rigid, molded synthetic resin with conical eye 22 (FIG. 2) extending through the top of the grip wall with the diameter of the eye expanding toward the inside face of the grip wall. The end of cable 20 is passed downward through eye opening 22 in a grip and a plug (hidden from view within the cable) of greater diameter than the the core of the tubular cable, is inserted into the end of the cable to provide a stop which prevents the cable from being pulled from grip 21 or 21' through eye opening 22.

Grip 21 is additionally provided with quick change spherical plug 23 comprising ball portion 24 and attached retaining loop portion 25. As shown in FIG. 2, the effective length of cable 20 can be be adjusted extending the end of cable 20 any desired distance beyond eye opening 22 and manually pressing ball portion 24 into the inside face opening of eye 22 to cause cable 20 to be wedged between the wall of the bore and ball portion 24. When tension is applied to the length of cable between grips 21, 21', the wedging effect is increased, seating ball portion 24 more firmly in conical eye opening 22.

Figure 3:
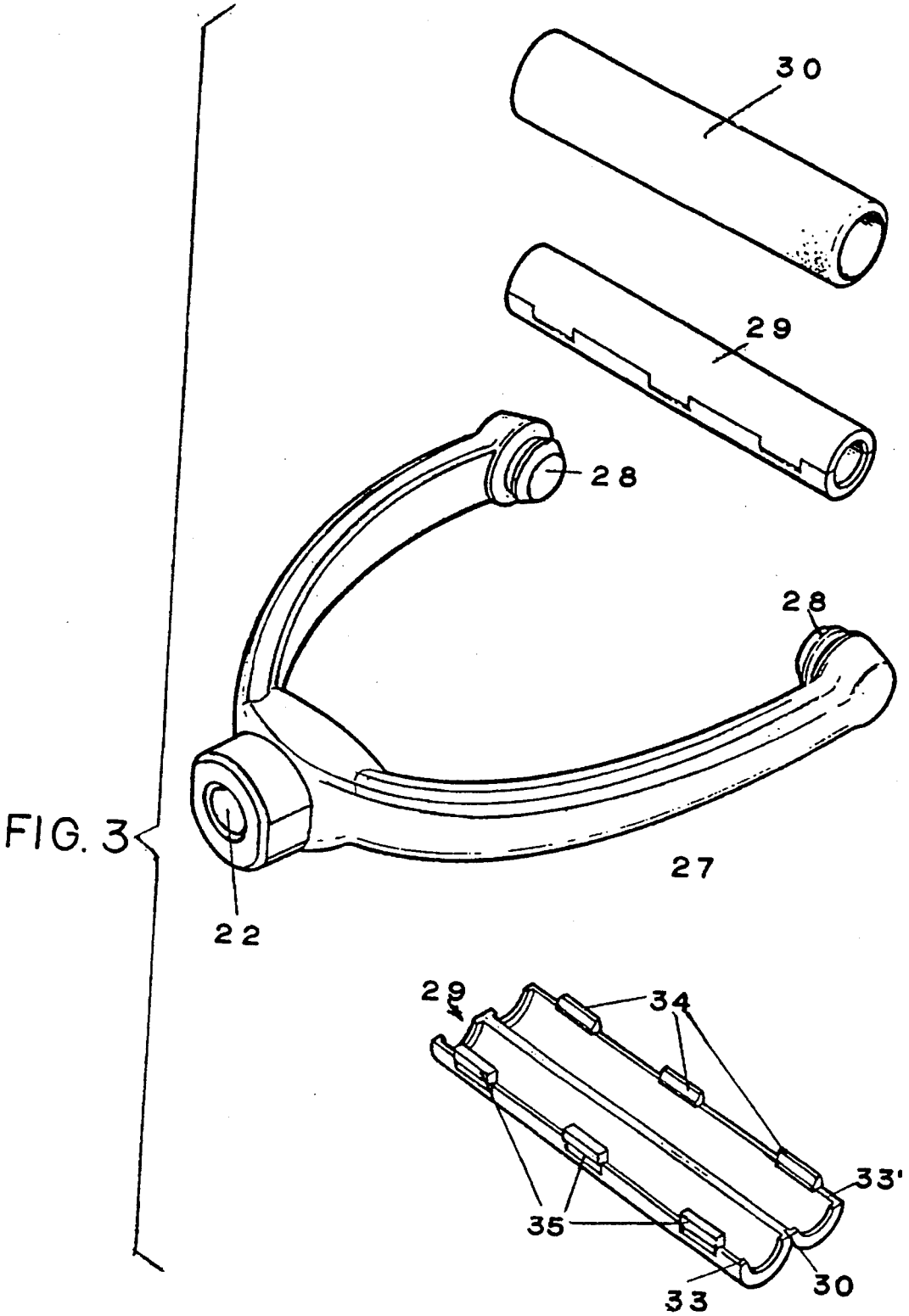
FIG. 3 is an exploded view of one embodiment of the rotator grip embodiment of FIG. 1.

Grip 21 as shown in FIG. 3 comprises yoke 27 configured with conical eye opening 22 and lugs 28 protruding laterally inward at the ends of yoke 27, upon which rotator 29 is journaled as shown in FIG. 1. As shown in FIG. 3, rotator 29 is configured as a longitudinally split tube with thin wall section 31 diametrically opposite wall split edge faces 33, 33'. This wall section 31 acts as a hinge which enables rotator 29 to be spread open manually for enabling end portions of the tubular rotator to be placed around lugs 28 in operable manner. Snap-lock configured tooth portions 34 and mating shoulder portions 32' are arrayed along edge faces 33, 33' in operable manner so that once rotator 29 is engaged on lugs 28, rotator 29 can be squeezed shut to lock tooth and shoulder portions 34, 35 together to secure rotator 29 on yoke 27 of grip 21. Rubber foam resilient sleeve 30 provides a soft, padded sheath for rotator 29, and is sufficiently pliant so that it can be operably stretched diametrically and compressed longitudinally to enable rotator 29 to be applied to yoke 27, when it is applied to rotator 29 prior to assembly of the rotator on yoke 27. Preferably, rotator 29 is molded synthetic resin possessed of requisite stiffness and flexibility for use in such application.

Figure 4:
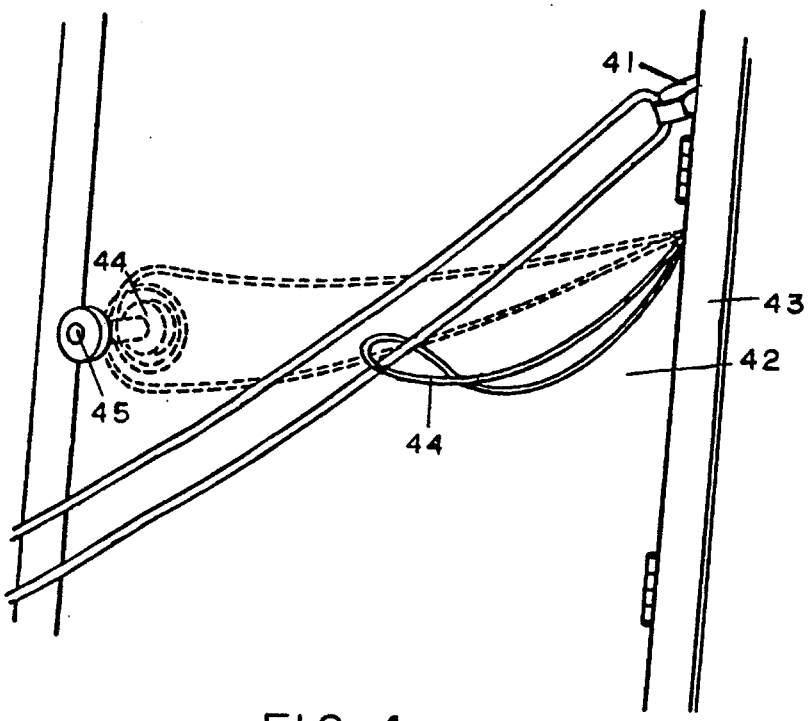
FIG. 4 is an elevation view of an elastic cable equipped with one embodiment of a safety loop of this invention shown mounted on a door in a manner suitable for exercise use of a cable.
Figure 16:
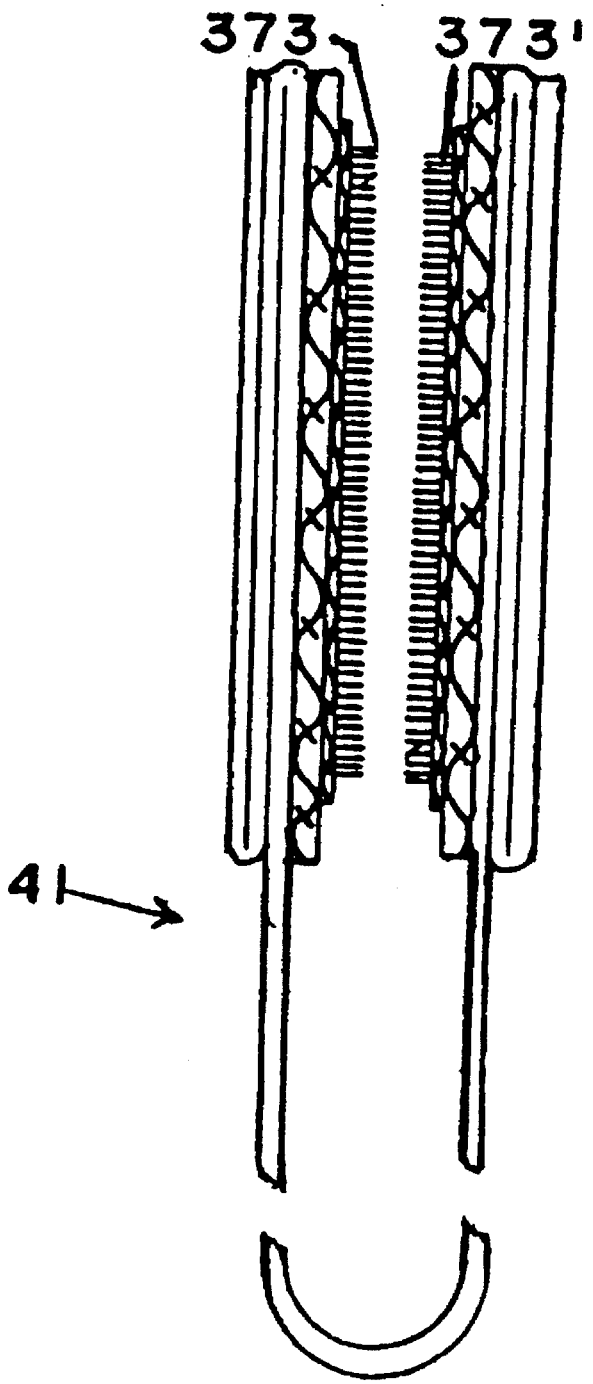
FIG. 16 is a detailed side elevation view of anchor strap 41 of FIG. 4.

In FIG. 4, elastic cable 20 is shown provided in mid-length with anchor strap 41. The strap, preferably made of woven Nylon webbing, which is folded over onto itself at the ends and stitched together to form a double or triple thickness. The thickened ends of anchor strip 41 may themselves either be stitched together to form a loop configuration for the strap, or have hook-and-loop fiber closure patches, such as VELCRO, sewed onto the inner facing surfaces to provide and openable and re-closable loop configuration. The latter construction enables band 41 to be used in conjunction with hinged mounted doors which provide only a narrow gap on the hinge side between door and door jamb when the door is open. With door 42 closed in jamb 43, as shown, thickened ends of band 41 are too bulky to slip between the door and jamb and serve to anchor cable 20 in operable manner. To insert or remove band 41 from between the door and door jamb, it may be required to utilize the Velcro equipped band if the thickness of the sewed together loop is too great to pass between the door in opened position and the door jamb. Band 41 is shown in greater detail in FIG. 16 with Velcro patches 373, 373' similar to pads 273, 273' detailed in FIG. 7 being shown.

Safety loop 46 comprises a closed cord loop extending from one side of door 42 where cable 20 is threaded through the loop, to pass between door 42 and door jamb 43 on the hinged side of the door and continue across the face of the opposite side of door 42 to doorknob 44 where several turns around the doorknob secure the loop to the door. During use of the apparatus, door lock button 45 on the user's side of door 42 should be engaged to lock the door to prevent the door from being unwittingly opened, but if such an event were to occur, safety loop 46 would prevent total loss of restraint of cable 20.

Figure 5:
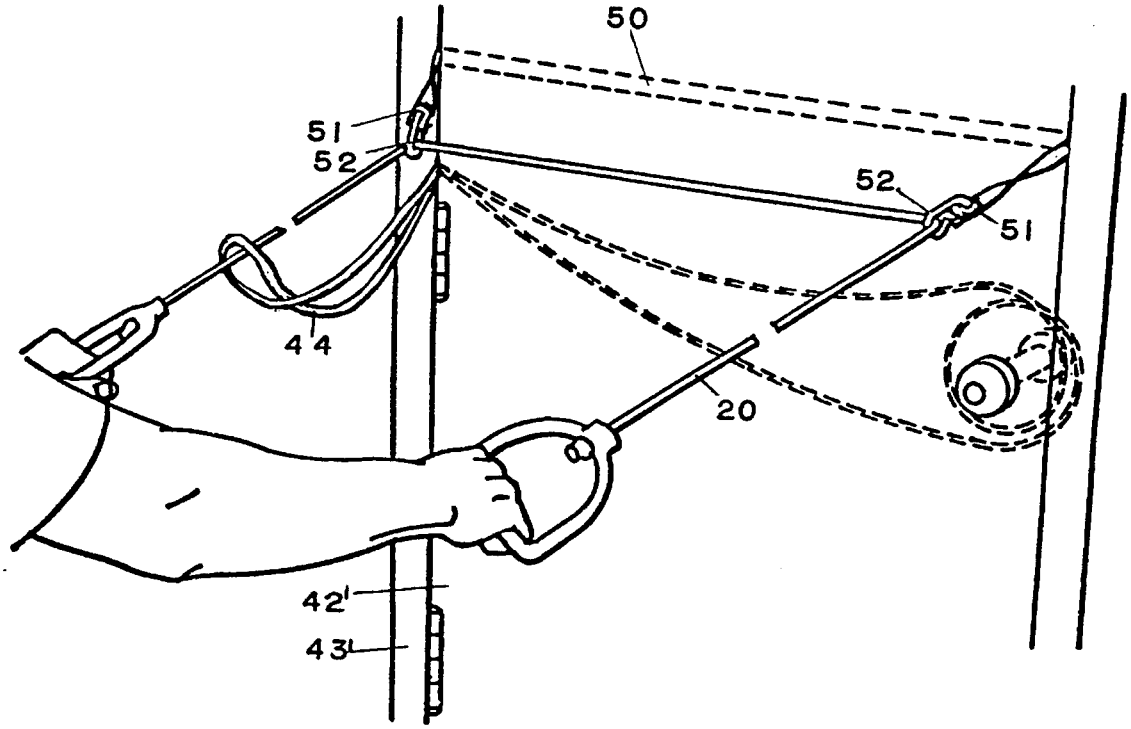
FIG. 5 is an elevation view of another embodiment of an elastic cable safety loop mounted on a door in a different manner suitable for use of exercise cable.
Figure 11:
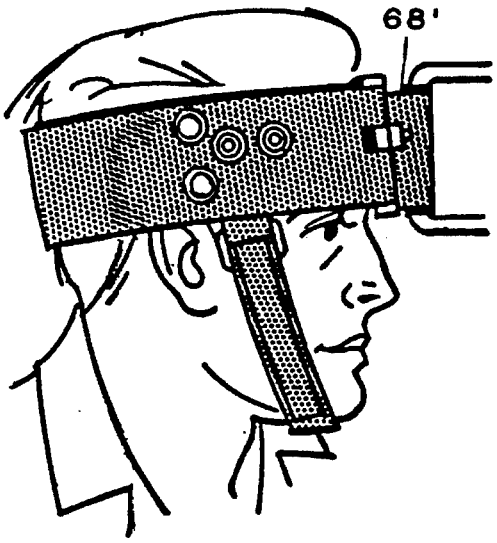
FIG. 11 is a right side perspective view of a person fitted with the head harness of FIG. 7 is a manner suitable for neck, lateral rotation exercise.
Figure 12:
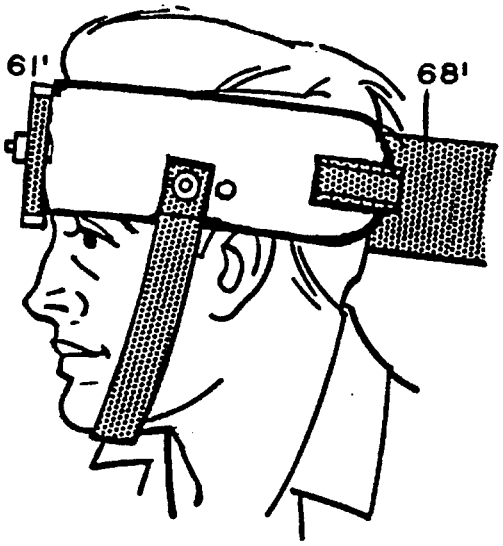
FIG. 12 is a left side perspective view of a person fitted with the head harness of FIG. 7 in a manner suitable for neck, lateral rotation exercise.

FIG. 5 shows exercise apparatus similar to that of FIG. 4 with cable anchor strap 50 extending laterally across the face of door 42' opposite from the side on which a user is located and passing between door 42' and door jamb 43' on each side of the door with the ends of strap 50 being fitted with grommets 51 into which links 52 are hooked. Links 52 are configured with hook shaped ends suitable for being engaged in grommets 51 at one end of each link and around cable 20 with the other end of each link. The end engaging cable 20 preferably provides a sufficiently narrow passage to require the cable to be squeezed when engaging the cable with the link as a precautionary measure to prevent inadvertent disengagement of the cable from the link. Safety cable 46' is applied to cable 20 in similar manner to that shown in FIG. 5.

Figure 6:
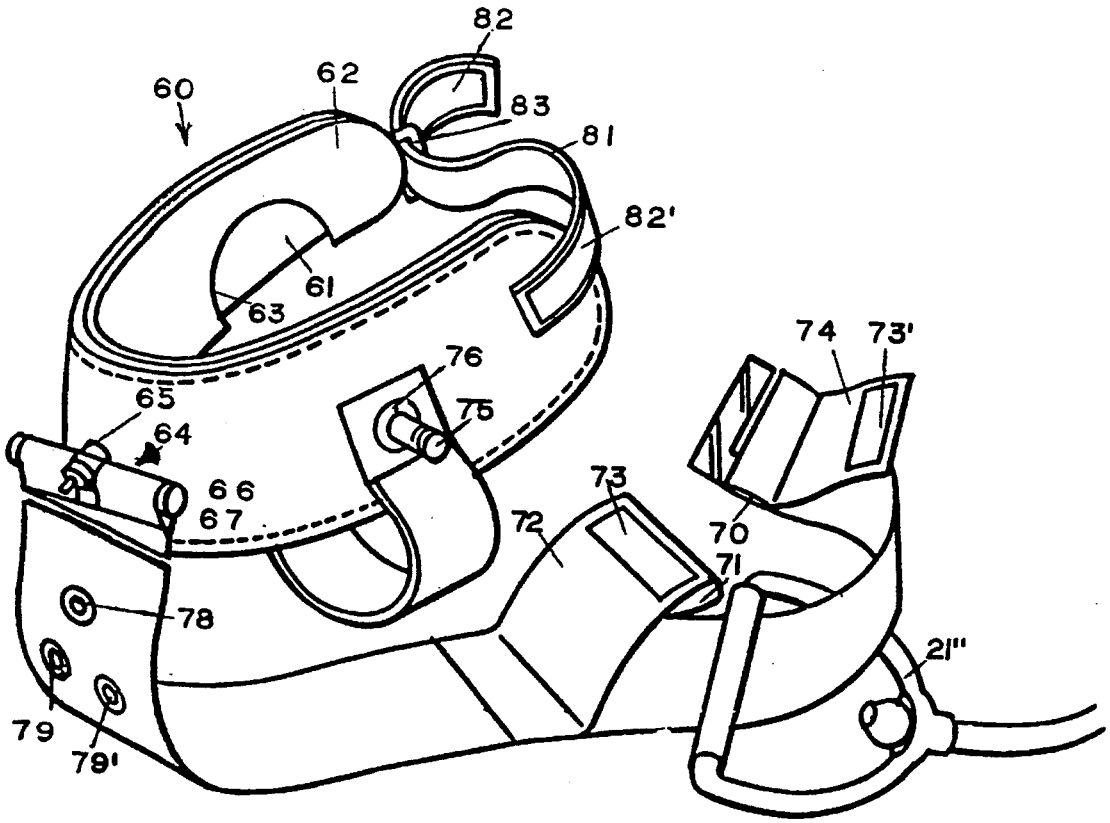
FIG. 6 is a schematic perspective view of one embodiment of a head harness of this invention shown in conjunction with a grip at the end of an elastic cable to which it is attached.

FIG. 6 shows an appliance for use with elastic cable by being belt connected to grip 21". Head harness 60, used for exercising neck muscles, comprises head band 61, preferably made of leather, leather substitute such as vinyl cover fabric, or other suitable material. As shown, headband 61 is lined with sponge rubber layer 62 which is provided with ear cutouts 63, and is applied to the headband in the manner described below with respect to FIG. 7. Swivel connector 64 is located at the rear of headband 61, as shown, and comprised fixed stud 65 with rotatively mounted lateral crossbar 66 onto which hemmed hoop 67 of connector strap 68 is applied. The free end of connector strap 68 comprises rigid "U" shaped buckle 69 engaged with the strap by having one leg inserted in hemmed loop 70 of the strap and the other leg disposed for being engaged in hemmed loop 71 of branch strap 72 which is sewed on to strap 68. Hook-and-loop fiber pads 73, 73' such as Velcro pads 273, 273' shown in FIG. 7, are provided on branch strap 72 and flap 74 which overlays buckle 69 when fastened.

Threaded stud 75 is shown operably fixed to project laterally from the right side of headband 61 for receiving thereon grommet 76 of chin strap 77. A similar stud projects from the left side of headband 61, but is obscured from view in FIG. 6. It receives thereon a chin strap anchor in similar manner to that shown for stud 75, the device having a belt loop secured to the lower, free end of the chin strap anchor through which chin strap 77 is passed and folded back on itself for being secured in place by pressing together patches of hook and loop fiber connectors in manner similar to that described below for closure strap 81.

Grommet 78 of connector strap 68 is operably disposed to engage stud 75 in overlaying position on grommet 76 when connector strap 68 is wrapped around the outside of headband 61 for a quarter turn, and additionally either of grommets 79, 79', set substantially at forty-five degrees to grommet 78 with respect to the centerline of belt 68, will also additionally engage stud 75, or its counterpart on the opposite side of headband 68, when connector strap 68 is folded to extend upward, over the top of a user's head from stud 75 or from its counterpart. By grommet 78 and one of grommets 79, 79' both being received on stud 75, belt 68 is restrained in a manner similar to that shown in FIG. 13 for the embodiment of FIG. 7, enabling it to be used for lateral flexion exercises of the neck muscles. If strap 68 is not folded in the described manner, it may be wrapped farther over the outside of headband 61 for use in any manner illustrated in FIGS. 11, 12, 14, and 15 relative to the embodiment of FIG. 7. Headband closure strap 81 is shown threaded through guide loop 83 for being pulled taut and doubled back onto itself and secured by pressing together hook-and-loop fiber patches 82, 82'. Head harness 60 is properly secured on a user's head when chin strap 77 and closure strap 81 are properly fastened. Headband 61 may be reversed on a user's head by placing closure strap 81 at the rear with equal utility as illustrated in FIGS. 11, 12, 13, and 15 relative to the embodiment of FIG. 7.

Figure 7:
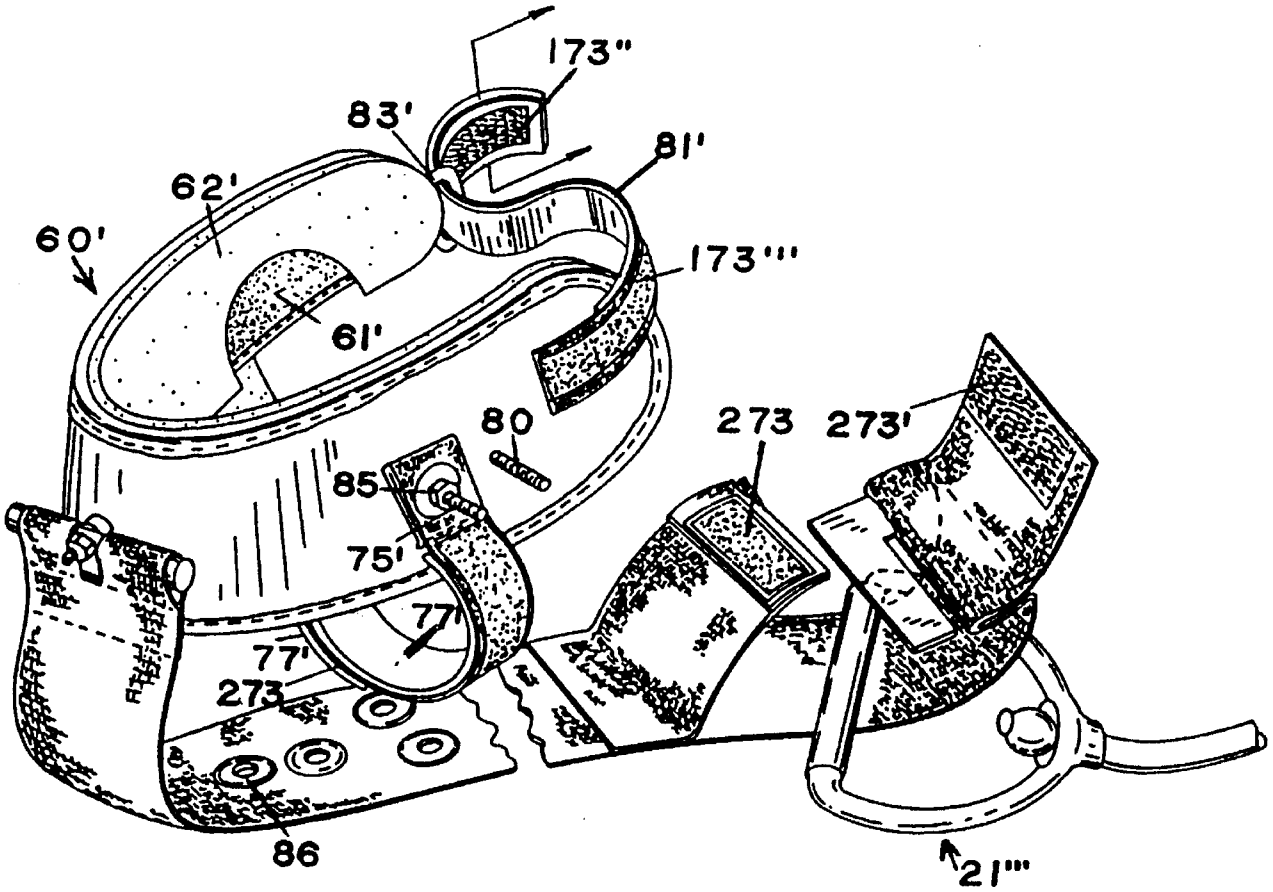
FIG. 7 is a perspective view of another embodiment of a head harness of this invention shown in conjunction with a grip at the end of an elastic cable to which it is attached.

In FIG. 7 a preferred embodiment of a head harness of this invention is shown. Head harness 60' differs from head harness 60 of FIG. 6 only in provision of stud 80 in addition to stud 75' on the side of headband 61', and the addition of grommet 86 on connector strap 68'. The provision of studs 75' and 80 in near adjacency on the sides of headband 161 and of grommet 86 on connector belt 68' for engaging stud 80 improves the fit and comfort of the head harness without interfering with utilization.

Figure 8:
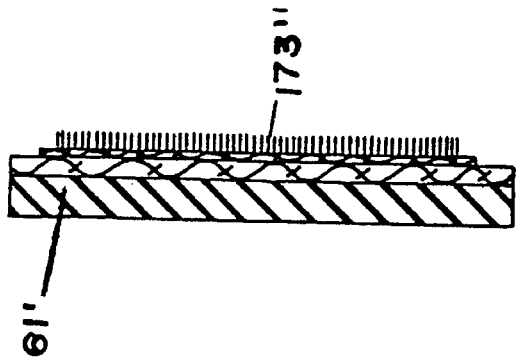
FIG. 8 is a cross section view taken on cutting plane 8—8 of FIG. 7.

Chin strap 77' is fastened by running the strap through a guide loop, not shown, similar to guide loop 83 of closure strap 83', and doubling the strap back onto itself with hook-and-loop fabric patch facings on the strap, applied similarly to patches 173", 173'" on closure strap 81', being pressed together to form a layer between the two thickness of strap 77'. A cross section of a portion of closure strap 81' showing patch 173''' is shown in FIG. 8. The structure of chin strap 77' is similar.

Figure 9:
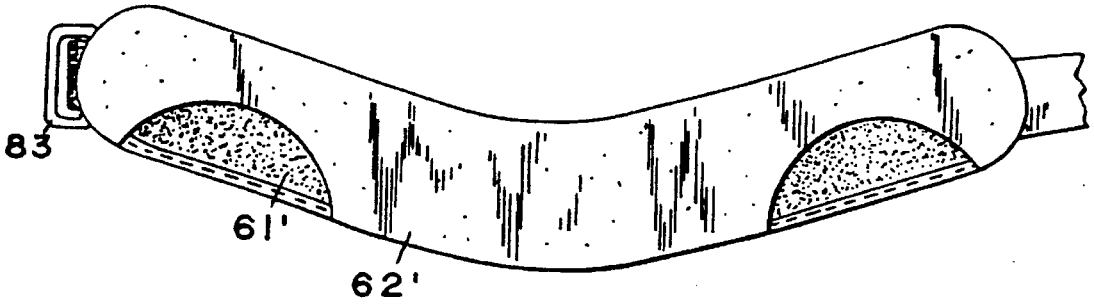
FIG. 9 is an elevation view of the head band of the head harness of FIG. 7 in linearly extended postion.
Figure 10:
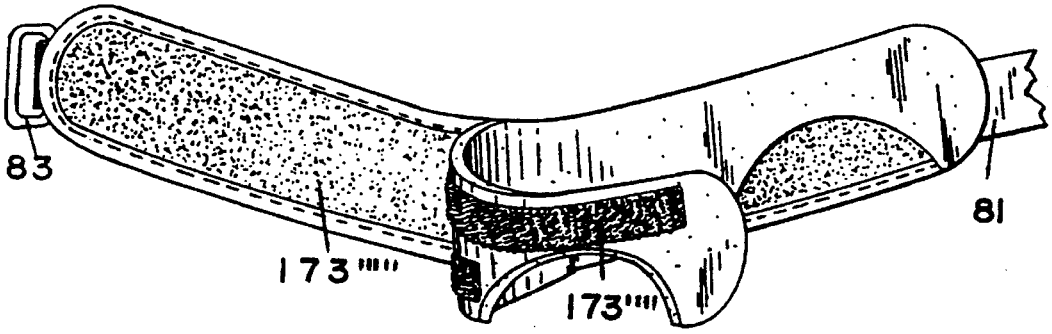
FIG. 10 is another view of the head band of FIG. 9 shown with the inner lining of the band partially folded back.

FIGS. 9 and 10 illustrate headband 61' in linearly extended position as being curvilinearly arced through an angle of substantially thirty degrees. Headband 61' is formed to provide a shape substantially that of the surface of an ellisoidal section when applied to a user's head with chin strap 77' and closure strap 81' properly fastened. Resilient rubber foam layer 62' is shown lining the inner face of headband 61' with hook-and-loop fiber patches 173'''', 173''''', respectively, being applied to the surfaces for securing foam layer 62' to headband 61'.

Figure 13:
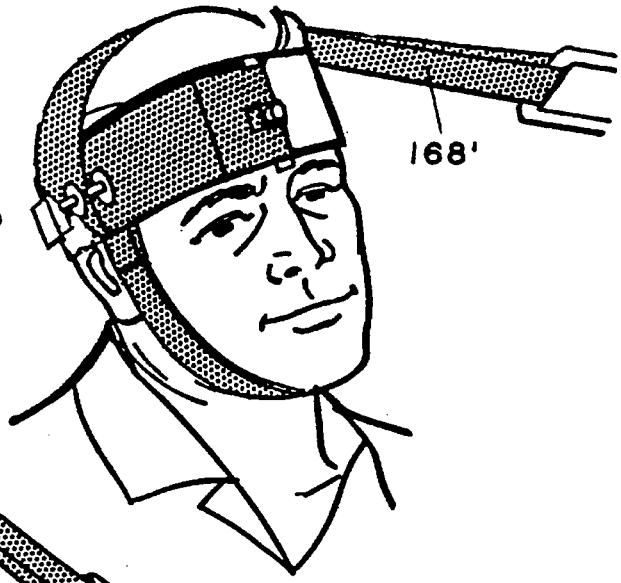
FIG. 13 is a right front perspective view of a person fitted with the head harness of FIG. 7 in a manner suitable for neck, lateral flexion exercise.
Figure 14:
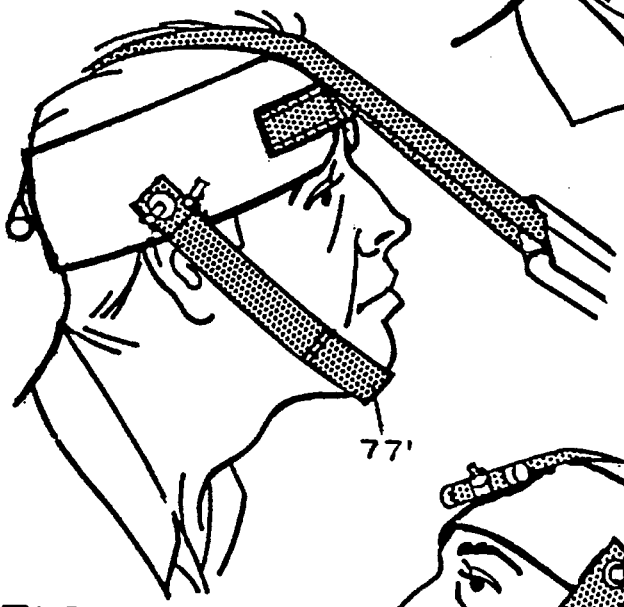
FIG. 14 is a right side elevation view of a person fitted with the head harness of FIG. 7 in a manner suitable for neck extension exercise.
Figure 15:
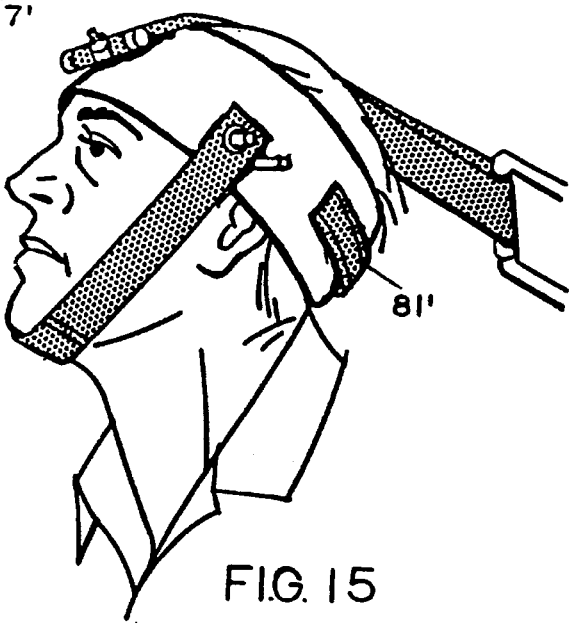
FIG. 15 is a left side elevation view of a person fitted with the head harness of FIG. 7 in a manner suitable for neck flexion exercise.

Belt 68' is pivotally mounted on head harness 60' by means of a swivel connector in the manner described relative to head harness 60 of FIG. 6, and may be positioned by placing grommet 86 on stud 75' so as to overlay threaded nut 85, which is shown applied to stud 75' for securing strap 77', and by engaging grommet 78' on stud 80. Studs 75', 80 are symmetrically arranged on each side of headband 61'. However, unlike the embodiment of FIG. 6, folding of belt 68' at forty-five degrees to extend over the top of a user's head as shown in FIG. 13 is accomplished in the embodiment of FIG. 7 at stud 80 so that grommet 79, or 79' engages stud 80 rather than stud 75' as would be the case if the procedure followed that described with respect to the embodiment of FIG. 6. In the illustration of FIG. 13, as well as in those of FIGS. 11, 12, and 15, the position of head harness 60' on a user's head is reversed from that hereinabove described and as shown in FIG. 13, for better utility.

FIGS. 11, 12, 13, 14, and 15 show head harness 60' being used, respectively, for neck muscle exercises in lateral rotation against forward applied resistant force, rearward applied resistant force, lateral flexion, extension, and flexion. As shown in FIG. 7, belt 68' is preferably attached to grip 21''' on cable 20 for performing the exercises, however other means such as weights may be substituted for elastic cable means.

I claim:

1. In exercise apparatus for conditioning neck muscles, a head harness comprising a) a band for encircling a person's head at forehead level, said band being substantially corvilinear when extended, b) an adjustable length closure for connecting the ends of said band to fit a user's head, c) a pivot post fixedly disposed intermediately between the ends of said band, said post having a pivotal mounting means affixed thereto for securing a belt, d) a belt configured with a first end extremity secured to said pivot post for being rotatable thereon, and second end extremity provided with a buckle which fastens to form an openabvle loop for securing said second end of said belt to another object, sais belt being further configured with at least two openings therethrough disposed intermediate said end extremities and aligned one to the other at an angle of substantially forth-five degrees to the centerline of said belt, e) at least one fixed stud disposed on said band intermediate at least one end of said band and said pivot post for being received through said two openings in said belt when said belt is folded at forty-five degrees with said two openings disposed in co-axial alignment, thereby enabling said belt to operably extend perpendicularly from said band at said post, f) a chin strap securing said head harness to the head of a user.

2. The head harness of claim 1 further comprising a second fixed stud disposed on said band and at least a third opening in said belt for receiving said second stud therethrough.

3. The exercise apparatus of claim 1 wherein said adjustable length closure comprises hook-and-loop fiber pads.

4. The exercise apparatus of claim 1 wherein said pivotal mounting means affixed to said pivot post comprixes a swivel mounting.

5. The exercise apparatus of claim 1 wherein said belt second end extremity comprises a branch strap to which said buckle attaches to form said openable loop.

6. The exercise apparatus of claim 1 wherein said belt second end extremity comprises a branch strap with the free end thereof hemmed for receiving said buckle therein to form said openable loop.

7. The exercise apparatus of claim 1 wherein a further opening is provided in said belt set substantially in perpendicular alignment to said alignment of said two openings through one of said two openings to provide a substantially symmetrical pattern of three openings through said belt with two openings thereof being aligned transversely perpendicular of said belt.

* * * * *